United States Patent [19]

Jardine

[11] Patent Number: 4,563,002

[45] Date of Patent: Jan. 7, 1986

[54] JUMP ROPE

[76] Inventor: George W. Jardine, 12 Lake Rd., Waltham, Mass. 02154

[21] Appl. No.: 555,053

[22] Filed: Nov. 25, 1983

[51] Int. Cl.[4] ..... A63B 5/20

[52] U.S. Cl. ..... 272/75

[58] Field of Search ..... 272/75; 273/58 C, 414

[56] References Cited

U.S. PATENT DOCUMENTS

| | | | |
|---|---|---|---|
| 633,590 | 9/1899 | Hinkson et al. | 272/75 |
| 1,666,201 | 4/1928 | Goldstein | 272/75 |
| 2,253,075 | 8/1941 | Johnson | 272/75 |
| 3,363,898 | 1/1968 | Crovello | 272/75 |
| 3,517,931 | 6/1970 | Kalish | 272/75 |
| 4,136,866 | 1/1979 | Bouvier | 272/75 |
| 4,375,886 | 3/1983 | Muys | 272/75 |

FOREIGN PATENT DOCUMENTS

| | | | |
|---|---|---|---|
| 775764 | 6/1936 | France | 272/75 |
| 328469 | 4/1958 | Switzerland | 272/75 |
| 2075349 | 11/1981 | United Kingdom | 272/75 |

OTHER PUBLICATIONS

Popular Mechanics, Mar. 1979, p. 170, "Rediscover the Jump Rope".

*Primary Examiner*—Richard J. Apley
*Assistant Examiner*—S. R. Crow
*Attorney, Agent, or Firm*—Robert T. Gammons

[57] ABSTRACT

A jump rope provided with a handle at each end structured to rotatably receive the end of the rope to prevent twisting of the rope when the jump rope is swung.

1 Claim, 4 Drawing Figures

JUMP ROPE

BACKGROUND OF THE INVENTION

Various means have been devised for rotatably connecting the ends of a jump rope to handles at the ends to prevent twisting as shown, for example, in U.S. Pat. Nos. 1,462,088 and 2,503,567; British Pat. No. 755,736; and Italian Pat. No. 498,972. It is the purpose of this invention to provide an improved means for connecting the handle to the end of a jump rope which is inexpensive, reliable and affords an exceptionally good connection between the rope and the handle.

SUMMARY OF THE INVENTION

As herein illustrated, the jump rope is provided with handles, one at each end, to enable swinging the rope without imparting a twist thereto, wherein each handle comprises a rigid, elongate, hollow structure of circular cross section from end-to-end, said structure defining at one end a first axial opening of a diameter to receive the end of the rope and inwardly thereof a second axial opening of larger diameter such that there is an annular shoulder at the junction of the first and second openings, said rope being positioned with its end within the first and second openings. A metal sleeve of larger diameter than the first opening and smaller diameter than the second opening is crimped to the end of the rope within the second opening adjacent, but spaced from, the terminal end of the rope such that the terminal end of the rope protrudes from the sleeve and the protruding end of the rope is brazed. There is a third opening beyond the second opening defining with the second opening a second annular shoulder and a stopper is force-fitted into the third opening against the second shoulder to capture the crimped end of the rope within the second opening.

The invention will now be described in greater detail with reference to the accompanying drawings, wherein.

Figure 1:
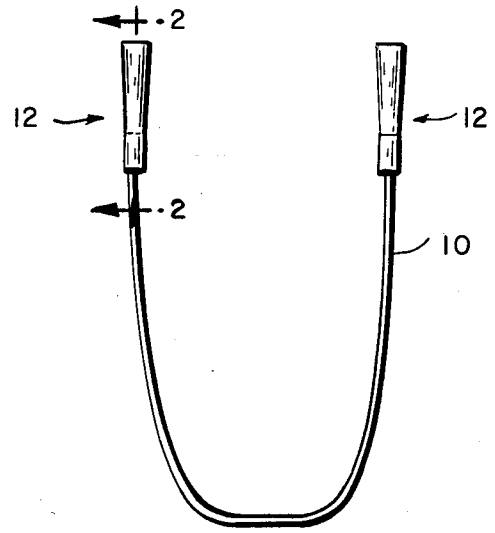
FIG. 1 is an elevation of the jump rope of this invention.

Referring to the drawings, FIG. 1, the jump rope of this invention comprises a length of flexible rope 10, preferably formed of braided nylon, although it can be formed of other kinds of synthetic resin or natural fibers and may be of twisted construction rather than braided construction. At each end of the length of rope 10, there is a handle 12.

Figure 2:
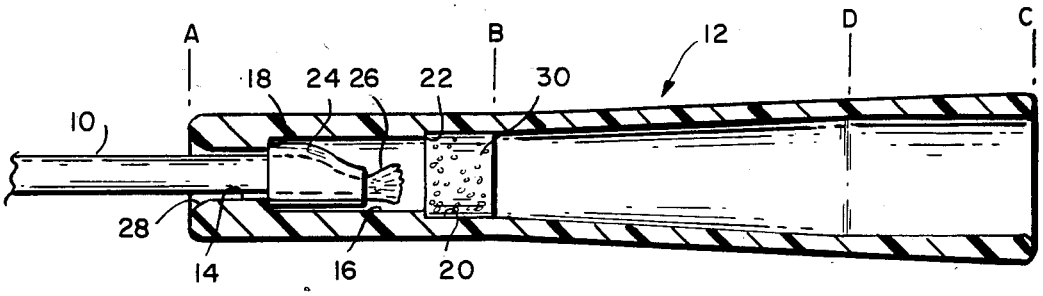
FIG. 2 is a longitudinal diametral section on the line 2—2 of FIG. 1.
Figure 3:
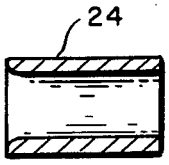
FIG. 3 is a section of the crimping sleeve employed for anchoring the end of the rope within the handle.

The handle 12, as shown in FIG. 2, is an elongate, rigid, hollow structure of circular cross section throughout its length. At one end, there is a first axial opening 14 of such diameter as to receive an end of the rope. Inwardly of the axial opening 14, there is a second axial opening 16 of larger diameter such that at the juncture of the openings 14 and 16, there is an annular shoulder 18. At the inner end of the second opening 16, there is a third axial opening 20 of larger diameter than the second axial opening 16 such that at the junction of the openings 16 and 20, there is a second annular shoulder 22. The openings 14, 16 and 20 are coaxial and uniformly cylindrical.

Figure 4:
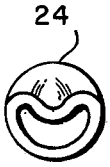
FIG. 4 is a section taken on the line 4—4 of FIG. 2.

The end of the rope to be rotatably secured in the handle 12 is inserted through the first axial opening 14 into the second axial opening 16 and a metal retaining sleeve 24 is crimped to it adjacent to, but spaced from, the terminal end of the rope such that there is a protruding portion 26. This protruding portion 26 is subjected to heat, for example, a flame from a torch or the like, to braze the strands making up the rope to each other at this end to thus prevent pulling of the strands relative to each other. The application of the sleeve 24 to the rope end, crimping thereof and brazing of the protruding end of the rope is accomplished by thrusting the cut end of the rope 10 all the way through the handle 12 to the larger end thereof, applying the sleeve to the rope, crimping it as shown in FIG. 4 and then brazing the distal end of the rope, whereupon the rope is drawn back through the handle to engage the sleeve with the shoulder 18. In this position, the crimped sleeve 24 and the distal end of the rope occupy the second axial opening 16. Desirably, the outer end of the handle peripherally of the axial opening 14 is flared or rounded as at 28.

In order to prevent the handle from sliding along the rope away from the sleeve 24, in other words, to maintain it at the end of the rope, a stopper 30 is force-fitted into the axial opening 20 against the shoulder 22. This may be a cork or a rubber plug.

The portion of the handle from A to B which embraces the axial openings 16, 18 and 20 is externally of uniform diameter. Desirably, but not necessarily, the remainder of the handle from B to C is externally conical, tapering from the diameter at B to a larger diameter at C, the distal end. Internally, the portion of the handle between B and C tapers and the portion of the handle between C and D is uniformly cylindrical to thus provide a greater wall thickness at the distal end of the handle and, hence, stiffening at the distal end of the handle.

The rope 10 is desirably about 5/16 of an inch in diameter and a nylon rope is preferred because it hangs well and is flexible. For children up to 15 years of age, the rope should be approximately 7 feet, 6 inches long and when installed with the handles, the overall length of the jump rope is 8 feet, 2 inches. For adults and upper teens, the rope should be approximately 8 feet, 6 inches long and when installed with the handles, the overall length would be 9 feet, 2 inches.

The molded plastic handles for children should be approximately 5 inches long and for adults 5½ inches long. The handles can be molded or machined from plastic rod.

For assembling the jump rope when nylon rope is used, it is cut to length and before it has a chance to ravel, it is passed through the opening 14 at the smaller end of the handle and through the anchor sleeve 24 so that about ⅛ of an inch protrudes from the anchor sleeve, whereupon the protruding end of the nylon rope is exposed to a small flame to braze the end, whereupon the anchor sleeve is pulled back about ½ an inch from the sealed end and crimped on the rope. The rope end with the crimped anchor sleeve can now be pulled against the shoulder 18 inside of the handle and a cork stopper 30 inserted against the shoulder 22.

The advantages of the jump rope as thus constructed are that there are no outside metal parts that can cause injuries to the hands of children or others using the rope, it is of simple, inexpensive construction and it insures that there will be free rotation between the handle and the rope ends without twisting.

It should be understood that the present disclosure is for the purpose of illustration only and includes all modifications or improvements which fall within the scope of the appended claims.

What is claimed is:

1. A jump rope provided at its opposite ends with handles structured to enable swinging the rope without imparting twists thereto comprising a flexible rope of predetermined length and diameter, each handle comprising a rigid, elongate, hollow structure of circular cross section from end-to-end, said structure defining in axial alignment commencing at one end a first cylindrical opening of a larger diameter than the rope to rotatably receive one end of the rope with a clearance therebetween, a second cylindrical opening of larger diameter than the first cylindrical opening such that there is a first annular shoulder at the junction of the first and second cylindrical openings, a third cylindrical opening of larger diameter than the second cylindrical opening such as to define a second annular shoulder at the junction of said second and third cylindrical openings and a tapering opening of progressively increasing diameter extending from the second annular shoulder to the opposite end of the handle, said rope being rotatably positioned in the first cylindrical opening with an end extending into the second cylindrical opening, a deformable metal sleeve of larger diameter than the first cylindrical opening applied to the rope within the second cylindrical opening with an end abutting the first annular shoulder at the junction of the first and second cylindrical openings and the other end spaced from the end of the rope and pinched into clamping engagement therewith, said rope end protruding from the pinched sleeve, and a stopper force-fitted into the third cylindrical opening against the second shoulder at the junction of the second and third cylindrical openings, for preventing axial movement of the rope in the handle said first cylindrical opening being internally flared at its outer end to inhibit wear at the point of entrance of the rope into the sleeve, that portion of the sleeve coextensive with the first, second and third openings being of uniform external diameter and the remainder of the sleeve of tapering, progressively increasing diameter from the aforesaid uniform diameter to a larger diameter at the distal end.

* * * * *